US006163910A

United States Patent [19]

Cheldin

[11] Patent Number: 6,163,910

[45] **Date of Patent: *Dec. 26, 2000**

[54] MULTI-FUNCTION TOOL COMBINING A WRITING IMPLEMENT WITH A LETTER OPENER AND A STAPLE PULLER

[76] Inventor: Erwin Cheldin, 23251 Mulholland Dr., Woodland Hills, Calif. 91364-2732

[ * ] Notice: This patent is subject to a terminal disclaimer.

[21] Appl. No.: 09/442,415

[22] Filed: Nov. 18, 1999

Related U.S. Application Data

[63] Continuation-in-part of application No. 09/287,254, Apr. 7, 1999, Pat. No. 6,065,169.

[51] Int. Cl.[7] ..... B26B 11/00

[52] U.S. Cl. ..... 7/160; 7/158

[58] Field of Search ..... 7/158, 151, 160, 7/161

[56] References Cited

U.S. PATENT DOCUMENTS

| | | | |
|---|---|---|---|
| D. 114,629 | 5/1939 | Becker | D19/73 |
| D. 352,217 | 11/1994 | Hochfeld et al. . | |
| 1,690,980 | 11/1928 | Johnson | 30/155 |
| 2,356,693 | 8/1944 | Polzer . | |
| 2,400,988 | 5/1946 | Goessel . | |
| 4,028,758 | 6/1977 | O'Connor . | |
| 4,670,926 | 6/1987 | Bruno . | |
| 5,638,566 | 6/1997 | Wu | 7/167 |
| 5,720,062 | 2/1998 | Vaught | 7/160 |
| 6,065,169 | 5/2000 | Cheldin | 7/160 |

*Primary Examiner*—James G. Smith
*Assistant Examiner*—David B. Thomas
*Attorney, Agent, or Firm*—Kelly Bauersfeld Lowry & Kelley, LLP

[57] ABSTRACT

The present invention resides in a multi-function tool which combines a writing implement with a letter opener and a staple puller. The staple puller and letter opener are either formed integrally with the elongated body of the writing implement, or are formed on a removable cap that may be placed over either end of the elongated body.

19 Claims, 2 Drawing Sheets

MULTI-FUNCTION TOOL COMBINING A WRITING IMPLEMENT WITH A LETTER OPENER AND A STAPLE PULLER

RELATED APPLICATION

This application is a continuation-in-part of application Ser. No. 09/287,254, filed Apr. 7, 1999, U.S. Pat. No. 6,065,169 entitled COMBINATION LETTER OPENER AND WRITING INSTRUMENT.

BACKGROUND OF THE INVENTION

The present invention relates to writing implements such as ink pens and mechanical pencils. More particularly, the present invention relates to a writing implement which includes a letter opener and a staple remover.

Writing implements are well known and have been in use for many years. There are a variety of writing implements frequently used in office and residential settings such as markers, wood pencils, mechanical pencils, ball point pens and retractable ink pens. The basic components of a typical writing implement include a hollow body support structure, which also acts as a handle, and the writing element which is usually disposed within the hollow body. A writing implement may include features such as erasers, pocket clips, retractable mechanisms, removable caps and other similar attachments.

Staple removers are also well known and are provided in two general forms, a double-jawed staple remover and a staple puller. The staple puller is generally comprised of a staple removing portion which is inserted beneath the staple, and a handle extending therefrom. After inserting the staple removing portion of the puller beneath the staple, the handle is pushed downwardly to force the staple upwardly.

There are also two general types of manually operated letter openers. The first is an elongated blade having a tapered point and rather dull edges. The blade is usually formed of metal and the tapered point is placed in an opening of the envelope flap and an edge of the blade forced through the paper flap of the envelope to reveal the contents of the envelope. The second type of letter opener is a rounded handle piece, usually comprised of hardened plastic, having a narrow channel formed by the handle piece and a protrusion of the handle. A cutting blade is positioned within the channel. An end of the protrusion is inserted under the flap which is guided through the channel and slit open by the cutting blade to reveal the contents of the envelope.

Letters are typically received in bulk periodically during the day or week. A person opening the letter envelopes, such as a receptionist or secretary, must find a letter opener or have a space reserved for the letter opener and the staple remover so as not to misplace or lose them. At times, the person opening the envelopes may not quickly find the letter opener and resorts instead to using other objects not designed to open letters, possibly resulting in excessive tearing of the envelope or even damage to the contents of the envelope.

Oftentimes while opening the letters, the person may need to use a writing instrument at nearly the same time as opening the letter in order to write notes, catalog the receipt of the letters and their contents, or for a variety of other reasons. The person may also need to remove staples to separate stapled articles. This tedious procedure requires putting either the letter opener or staple remover down and picking up the pen repeatedly to take notes while opening and sifting through envelopes, letters and other papers. This has been found to be very inconvenient.

Accordingly, what is needed is a multi-purpose tool which couples a letter opener and a staple remover to a writing implement in order to alleviate the inconveniences of using these devices separately. The present invention fulfills these needs and provides other related advantages.

SUMMARY OF THE INVENTION

The present invention resides in a multi-function tool which can be utilized as a writing instrument, letter opener and staple remover. The tool is generally comprised of a writing implement having an elongated body, a letter opener associated with an end of the writing implement, and a staple puller associated with the letter opener. The staple puller and letter opener are either formed integrally with the elongated body of the writing implement, or are formed on a removable cap that may be placed over either end of the elongated body.

The letter opener extends radially from the elongated body. The letter opener includes a finger which extends generally parallel to the elongated body and towards the staple puller so as to form a channel. A cutting element, typically a razor blade, is positioned within the channel.

The staple puller extends longitudinally from the elongated body. The staple puller includes a flexible guide which extends beyond and is intermediate an upper staple support clasp and a lower wedge. The guide is substantially planar and tapers to a rounded end.

A clip may be associated with the same end of the writing implement as the letter opener and staple puller. The clip is usually diametrically opposed to the letter opener relative to the elongated body, and extends longitudinally in a direction opposite the letter opener finger.

Other features and advantages of the present invention will become apparent from the following more detailed description, taken in conjunction with the accompanying drawings which illustrate, by way of example, the principles of the invention.

DETAILED DESCRIPTION OF THE PREFERRED EMBODIMENTS

Figure 1:
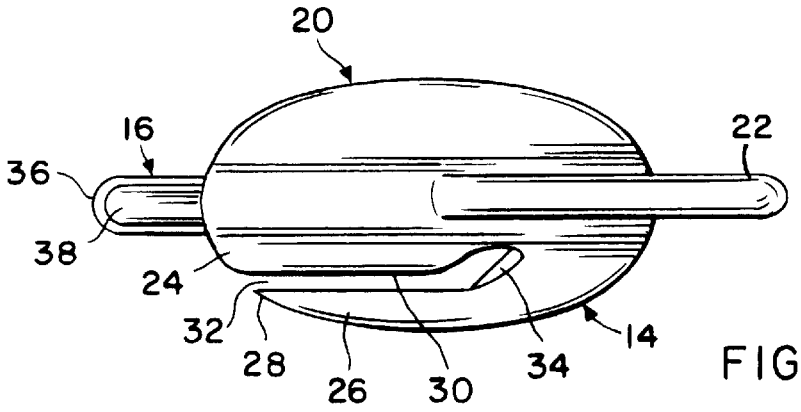
FIG. 1 is top plan view of a cap for a writing instrument having a clip, a letter opener and a staple puller formed thereon.
Figure 2:
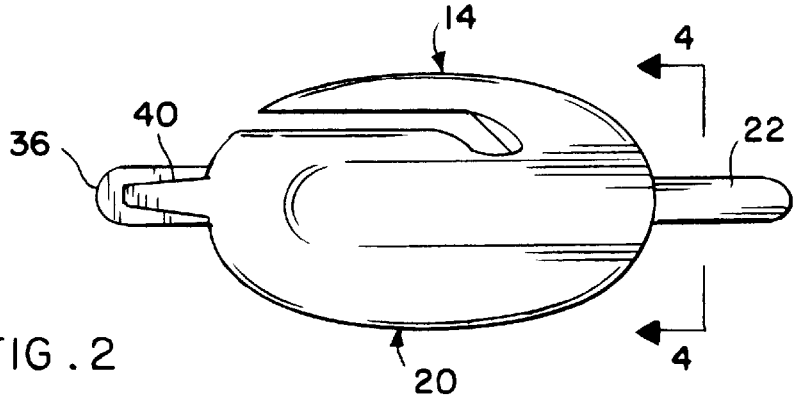
FIG. 2 is a bottom plan view of the cap of FIG. 1.
Figure 3:
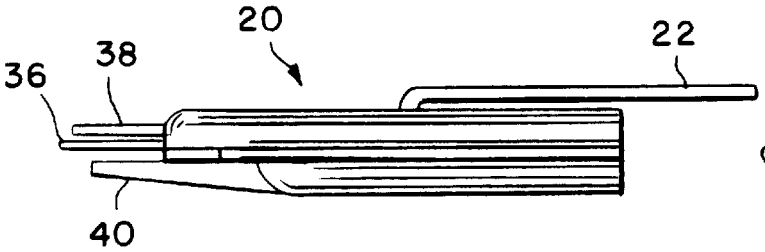
FIG. 3 is a side elevational view of the cap of FIGS. 1 and 2.
Figure 4:
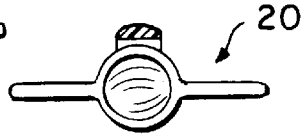
FIG. 4 is an end view of the cap of FIGS. 1–3, taken along the line 4—4 in FIG. 2.
Figure 5:
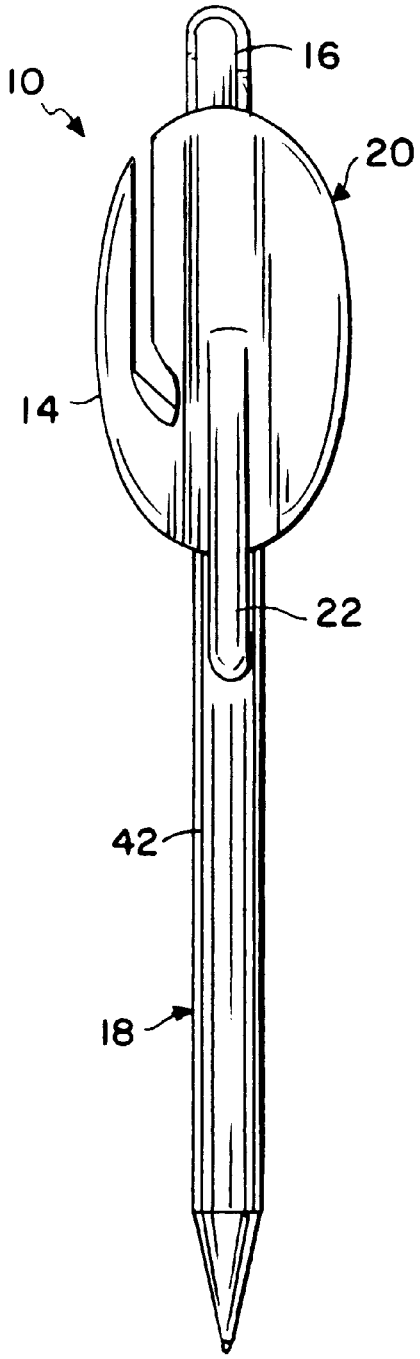
FIG. 5 is an elevational view of a writing instrument having the cap of FIGS. 1–4 attached thereto.
Figure 6:
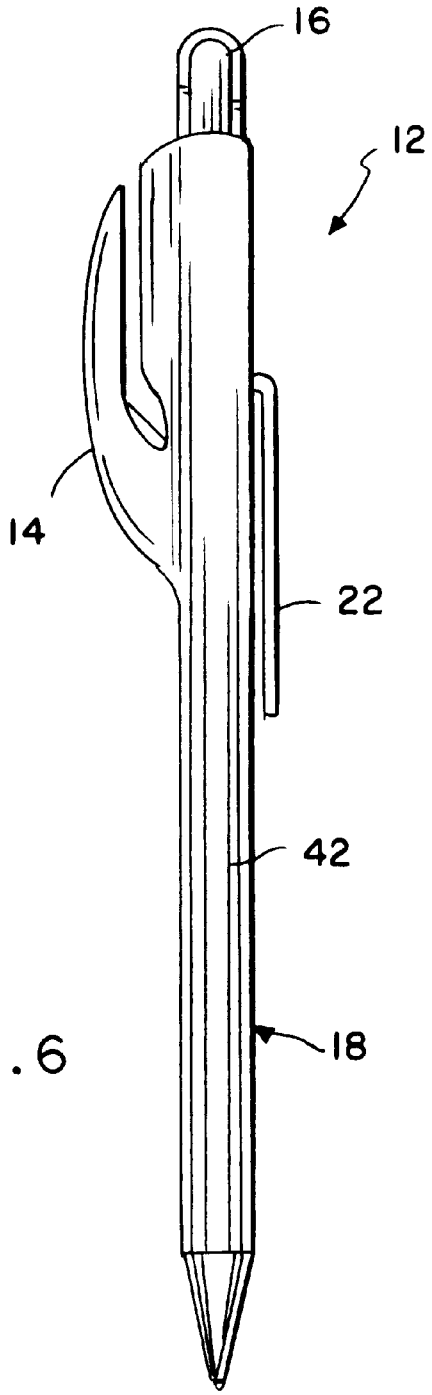
FIG. 6 is an elevational view similar to FIG. 5, illustrating another type of writing instrument having a clip, a letter opener and staple puller integrally formed therewith.

As shown in the drawings for purposes of illustration, the present invention is concerned with a multi-function tool, generally referred to by the reference number 10 in FIGS. 1–5, and by the reference number 12 in FIG. 6.

The present invention combines a letter opener 14, a staple puller 16 and a writing instrument 18 into one tool 10, 12, to grant more convenience to a user, such as a secretary or receptionist, who periodically needs to utilize more than one of these devices at nearly the same time.

In accordance with the invention and with reference to FIGS. 1–5, a first embodiment of the tool 10 is comprised of a removable cap 20 having the letter opener 14 and staple puller 16 integrally formed thereon. The cap 20 may also include a clip 22 which is used to hold the coupled cap 20 and writing instrument 18, which comprise the tool 10, in a pocket. The clip 22 is preferably oriented in an opposite direction as the letter opener 14 so that a user will not accidently insert and cut the fabric of the pocket with the letter opener 14. The writing instrument may be of any form including a pencil, marker or ink pen which is capable of receiving a removable cap.

The letter opener 14 generally comprises a frame 24 having a finger protrusion 26 extending and spaced apart from the frame 24 and tapered to a point 28. The frame 24 is typically a generally planar, one-piece member formed with the cap 20 on one or both sides thereof, but is not limited to a particular shape, width or size. The space between an inner edge 30 of the frame 24 and the finger protrusion 26 forms a paper accepting channel 32. A cutting element 34, preferably a triangular shaped metal razor blade, is positioned within the paper accepting channel 32.

To cut open an envelope, the tapered point 28 of the finger protrusion 26 is inserted into a small opening of a flap of the envelope. The finger protrusion 26 acts as a guide, feeding the flap of the envelope into the paper accepting channel 32 until the paper abuts the cutting element 34 where the flap is sliced open to reveal the contents of the envelope.

The staple puller 16 is formed on an end of the cap 20 opposite the cap opening and clip 22. The staple puller 16 includes a guide element 36 which tapers to a rounded end to facilitate the insertion of the guide element 38 beneath the staple while also preventing the ripping or tearing of the stapled article. The tapered guide element 36 also acts as a partial wedge when inserted beneath staples as the legs of the staples are pushed outward and somewhat upward as the guide element 36 is forcibly inserted into the staple. The guide element 36 is quite thin and somewhat flexible so as to be easily inserted beneath a staple. The guide element is generally comprised of metal, such as stainless steel, in order to withstand the forces applied to it and also to resist corrosion. Although generally planar, the guide element 36 may also be angled upwardly in order to further facilitate its insertion beneath an engaged staple.

Positioned above the guide element 36 is at least one support clasp 38 which also extends from the cap 20. Typically, the support clasp 38 does not extend from the handle to the same extent as the guide element 36. The support clasp 38 acts to clasp removed staples. The support clasp 38 also supports the guide element 26 during staple removal so that the guide element 36 does not bend or become otherwise distorted due to the forces applied to it. The support clasp 38 is typically comprised of the same material, usually plastic, as the cap 20.

Positioned below the guide element 36 is a wedge 40 which extends outwardly from the bottom of the cap 20. The wedge 40 has a thicker base which bevels along one side thereof out to a thinner end. The wedge 40 aids the user in the insertion of the guide element 36 beneath the staple, and also acts as a lever when disengaging the staple.

The staple puller 16 is used by forcibly inserting the guide element 36 beneath the staple. The user may utilize the beveled wedge 40 in order to aid in the insertion of the guide element 36. Once inserted, the user continues to thrust the staple puller 16 through the staple, wedging the legs further apart until they release from the article. The cap 20 alone can be used to remove staples or preferably the cap is attached to an end of the writing instrument 18 which is then used as a handle. If the staple is not removed by thrusting, either the cap or the body 42 of the writing instrument is pushed downwardly in a lever-like manner forcing the staple upward from the article.

Referring now to FIG. 6, the letter opener 14 and staple remover 16 may be formed integrally, by molding or permanent attachment, with the body 42 of the writing instrument 18 to form the tool 12. The body 42 of the writing instrument 18 may bulge and extend towards the finger protrusion 26 in order to form the paper accepting channel 32. Alternatively, the paper accepting channel 32 may be formed between the finger protrusion 26 and the standard body 42 of the writing instrument 18.

The clip 22 is formed on the side of the body opposite the letter opener 14 to prevent accidental cutting of fabric when the tool 12 is placed in a pocket. The letter opener 14 and staple remover 16 are used in the same manner as described above.

Although several embodiments have been described in detail for purposes of illustration, various modifications may be made without departing from the scope and spirit of the invention. Accordingly, the invention is not to be limited, except as by the appended claims.

What is claimed is:

1. A multi-function tool, comprising:

a writing implement having an elongated body;

a letter opener associated with an end of the writing implement and extending radially from the elongated body; and a staple puller associated with the letter opener and extending longitudinally from the elongated body.

2. The tool of claim 1, wherein the letter opener includes a finger which extends generally parallel to the elongated body so as to form a channel, and a cutting element positioned within the channel.

3. The tool of claim 2, wherein the cutting element comprises a razor blade.

4. The tool of claim 1, wherein the staple puller includes a flexible guide which extends beyond and is intermediate an upper staple support clasp and a lower wedge.

5. The tool of claim 4, wherein the guide is substantially planar and tapers to a rounded end.

6. The tool of claim 2, including a clip associated with the end of the writing implement and extending towards an opposite end thereof.

7. The tool of claim 6, wherein the clip is disposed diametrically opposite the letter opener relative to the elongated body, and extends longitudinally in a direction opposite that of the letter opener finger.

8. The tool of claim 1, wherein the writing implement includes a removable cap that may be placed over either end of the elongated body, and wherein the staple puller and the letter opener are formed with the cap.

9. The tool of claim 1, wherein the staple puller and letter opener are integrally formed with the elongated body of the writing implement.

10. A multi-function tool, comprising:

a writing implement having an elongated body;

a letter opener extending radially from the elongated body, the letter opener including a finger which extends generally parallel to the elongated body towards an end thereof so as to form a channel intermediate the finger and the elongated body, and a cutting element positioned within the channel; and a staple puller extending longitudinally from the end of the elongated body, the staple puller including a flexible guide which extends beyond and is intermediate an upper staple support clasp and a lower wedge.

11. The tool of claim 10, including a clip associated with the elongated body, wherein the clip is disposed diametrically opposite the letter opener relative to the elongated body, and extends longitudinally in a direction opposite that of the letter opener finger.

12. The tool of claim 10, wherein the cutting element comprises a razor blade.

13. The tool of claim 10, wherein the flexible guide is substantially planar and tapers to a rounded end.

14. A multi-function tool, comprising:

a writing implement having an elongated body and a removable cap that may be placed over either end of the elongated body;

a staple puller formed at an end of the cap; and a letter opener formed with the cap, the letter opener including a finger which extends generally parallel to the elongated body in a direction towards the staple puller so as to form a channel intermediate the finger and the cap, and a cutting element positioned within the channel of the letter opener.

15. The tool of claim 14, wherein the cutting element comprises a razor blade.

16. The tool of claim 14, wherein the staple puller includes a flexible guide which extends beyond and is intermediate an upper staple support clasp and a lower wedge.

17. The tool of claim 14, wherein the guide member is substantially planar and tapers to a rounded end.

18. The tool of claim 14, including a clip associated with the end of the writing implement and extending towards an opposite end thereof.

19. The tool of claim 18, wherein the clip is disposed diametrically opposite the letter opener relative to the elongated body, and extends longitudinally in a direction opposite that of the letter opener finger.

* * * * *